US010013935B2

(12) United States Patent
Hong et al.

(10) Patent No.: US 10,013,935 B2
(45) Date of Patent: Jul. 3, 2018

(54) GATE DRIVER, DISPLAY DEVICE WITH THE SAME AND DRIVING METHOD THEREOF

(71) Applicant: LG DISPLAY CO., LTD., Seoul (KR)

(72) Inventors: Seok Hyun Hong, Suwon-si (KR); Myung Gi Lim, Ansan-si (KR); O Sung Do, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/971,387

(22) Filed: Dec. 16, 2015

(65) Prior Publication Data

US 2016/0189646 A1 Jun. 30, 2016

(30) Foreign Application Priority Data

Dec. 31, 2014 (KR) ..... 10-2014-0195825

(51) Int. Cl.
*G09G 3/36* (2006.01)
*G09G 3/20* (2006.01)

(52) U.S. Cl.
CPC ..... *G09G 3/3611* (2013.01); *G09G 3/20* (2013.01); *G09G 2300/0426* (2013.01); *G09G 2310/0224* (2013.01); *G09G 2310/0286* (2013.01); *G09G 2310/08* (2013.01)

(58) Field of Classification Search
CPC . G09G 3/36; G09G 5/10; G11C 19/00; F21V 7/04; G06K 9/00
See application file for complete search history.

(56) References Cited

U.S. PATENT DOCUMENTS 9,030,398 B2 * 5/2015 Chung ..... G09G 3/3688 345/100
2006/0050043 A1 * 3/2006 Kawagoe ..... G09G 3/3648 345/98
2006/0202938 A1 * 9/2006 Chen ..... G09G 3/3611 345/100
2006/0227095 A1 * 10/2006 Kim ..... G09G 3/3659 345/100
2011/0025590 A1 * 2/2011 Lin ..... G09G 3/3677 345/100
2011/0210955 A1 * 9/2011 Chang ..... G09G 3/3677 345/212

(Continued)

FOREIGN PATENT DOCUMENTS

CN 101261376 A 9/2008
KR 10-2009-0085424 A 8/2009

(Continued)

*Primary Examiner* — Pegeman Karimi
(74) *Attorney, Agent, or Firm* — Birch, Stewart, Kolasch & Birch, LLP

(57) ABSTRACT

A display device according to an embodiment includes a display panel in which a plurality of gate and date lines are formed, and a gate driver configured to include first and second shift registers and a control portion. The first shift register is disposed opposite to odd-numbered gate lines of the display panel. The second shift register is disposed opposite to even-numbered gate lines of the display panel. The control portion transfers a first control signal to the first shift register, derives a second control signal from the first control signal, and applies the second control signal to the second shift register.

9 Claims, 5 Drawing Sheets

(56) References Cited

U.S. PATENT DOCUMENTS

| | | | | |
|---|---|---|---|---|
| 2012/0098800 | A1* | 4/2012 | Kim | G09G 3/3677 345/204 |
| 2013/0235026 | A1* | 9/2013 | Yamamoto | G11C 19/184 345/214 |

FOREIGN PATENT DOCUMENTS

| | | | |
|---|---|---|---|
| KR | 10-2014-0054974 | A | 5/2014 |
| KR | 10-2014-0126131 | A | 10/2014 |

* cited by examiner

GATE DRIVER, DISPLAY DEVICE WITH THE SAME AND DRIVING METHOD THEREOF

The present application claims priority under 35 U.S.C. § 119(a) of Korean Patent Application No. 10-2014-0195825 filed on Dec. 31, 2014, which is hereby incorporated by reference in its entirety.

BACKGROUND

Field of the Disclosure

The present application relates to a gate driver, a display device with the same and a driving method thereof.

Description of the Related Art

Recently, a variety of flat panel display devices with reduced weight and volume to address the disadvantages of cathode ray tube (CRT) are being developed. The flat panel display devices include liquid crystal display (LCD) devices, field emission display (FED) devices, plasma display panels (PDPs), electroluminescence devices and so on.

FIG. 1 is a block diagram showing a display device of the related art. FIG. 2 is a detailed block diagram showing the configuration of a gate driver IC (integrated circuit) chip disposed in the gate driver of FIG. 1.

Referring to FIGS. 1 and 2, the related art display device 10 includes a display panel defined into a display area 20 displaying images and a non-display area 30 surrounding edges of the display area 20. Also, the related art display device 10 includes a gate driver 12 and a data driver 13, which are disposed in the non-display area 30 of the display panel, and a printed circuit board (PCB) 50 configured to supply a plurality of control signals to the gate driver 12 and the data driver 13.

The printed circuit board 50 is loaded with a timing controller (not shown). The timing controller generates signals which will be applied to the gate driver 12 and the data driver 13.

Recently, the display device 10 becomes larger and higher in size and definition. In accordance therewith, a chip-on-glass (COG) display device has been proposed which allows the gate driver 12 and the data driver 13 to be mounted on the display panel.

Also, a line-on-glass (LOG) display device has been proposed which includes a plurality of signal lines formed on the non-display area 30 of the display panel. In the LOG display device, a flexible printed circuit board loaded with gate driver IC chips is directly connected to the plurality of signal lines on the non-display area of the display panel.

All the COG and LOG display devices have a common feature of forming the plurality of signal lines in the non-display area of the display panel.

As such, a plurality of signal lines 40 is formed in the non-display area 30 of the display panel. The plurality of signal lines 40 is used to transfer signals to the gate driver 12 and the data driver 13.

The gate driver 12 includes a plurality of gate driver IC chips. The data driver 13 includes a plurality of data driver IC chips.

FIG. 2 shows a configuration of a gate driver IC chip 60 which is disposed in the gate driver 12 of FIG. 1. The gate driver IC chip 60 includes a shift register 61 configured to include a plurality of stages (or flip-flops F/Fs) and an output portion 62 configured to transfer gate signals output from the shift register 61 to gate lines G_odd and G_even which are arranged on the display panel. The 'G_odd' indicates an odd gate signal applied to odd-numbered gate line of the gate lines arranged on the display panel. The 'G_even' indicates an even gate signal applied to even-numbered gate lines of the gate lines on the display panel.

As shown in the drawings, the gate driver IC chip 60 receives gate control signals from the timing controller disposed on the printed circuit board 50. Also, the gate driver IC 60 chip sequentially generates the gate signals using the gate control signals. For example, the gate control signals can include shift clock signals GSC1 and GSC2, gate start pulse signals GSPA and GSPB, gate output enable signals GOE1 and GOE2 and so on.

Such a COG or an LOG display device of the related art must force a large number of signal lines 40 for transferring the gate control signals to the gate driver 12 be formed in the non-display area 30 of the display panel. Due to this, it is difficult to reduce a bezel area of the display device 10. Moreover, the large number of signal lines 40 formed on the display panel must increase connection pins of the printed circuit board 50 which are connected to the signals line 40.

BRIEF SUMMARY

Accordingly, embodiments of the present application are directed to a display device and a driving method thereof that substantially obviate one or more of problems due to the limitations and disadvantages of the related art, as well to a light source module and a backlight unit each using the same.

The embodiments are to provide a gate driver, a display device with the same and a driving method thereof which are adapted to reduce the number of signal lines on a display panel by disposing a control portion, which selectively delays gate control signals, at the previous stage of the separated shift registers from each other and sequentially driving the separated shift registers.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

In order to solve or address the problems of the related art, a gate driver according to a general aspect of the present embodiment includes: a shift register configured to include a first shift register opposite to odd-numbered gate lines of a display panel and a second shift register opposite to even-numbered gate lines of the display panel; and a control portion configured to transfer a first control signal to the first shift register, derive a second control signal from the first control signal, and apply the second control signal to the second shift register. The two separated shift registers can be driven using only the control signal applied to one of the two shift registers. As such, the number of signal lines on the display panel can be reduced.

Also, a display device according to another general aspect of the present embodiment includes: a display panel in which a plurality of gate lines and a plurality of data lines are formed; and a gate driver which includes a first shift register opposite to odd-numbered gate lines of a display panel, a second shift register opposite to even-numbered gate lines of the display panel and a control portion configured to transfer a first control signal to the first shift register, derive a second control signal from the first control signal by delaying the first control signal, and apply the second control signal to the second shift register. The display device can drive the two shift registers, which output the gate signals the odd-numbered and even-numbered gate lines, using only the control signal applied to one of the two shift registers. As such, a bezel area of the display device can be reduced.

A display device driving method according to still another aspect of the present embodiment is applied to a display device which includes: a display panel configured to include a plurality of gate lines and a plurality of data lines; and a gate driver configured to include a first shift register opposite to odd-numbered gate lines of a display panel, a second shift register opposite to even-numbered gate lines of the display panel and a control portion connected the first and second shift registers. The display device driving method includes: enabling the control portion to derive a second control signal from a first control signal; applying the first control signal to the first shift register and the second control signal to the second shift register; and transferring first gate signals from the first shift register and second gate signals from the second shift register to the odd-numbered and the even-numbered gate lines. As such, the two shift registers, which output the gate signals the odd-numbered and even-numbered gate lines, can be driven using only the control signal applied to one of the two shift registers. In accordance therewith, a bezel area of the display device can be reduced.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
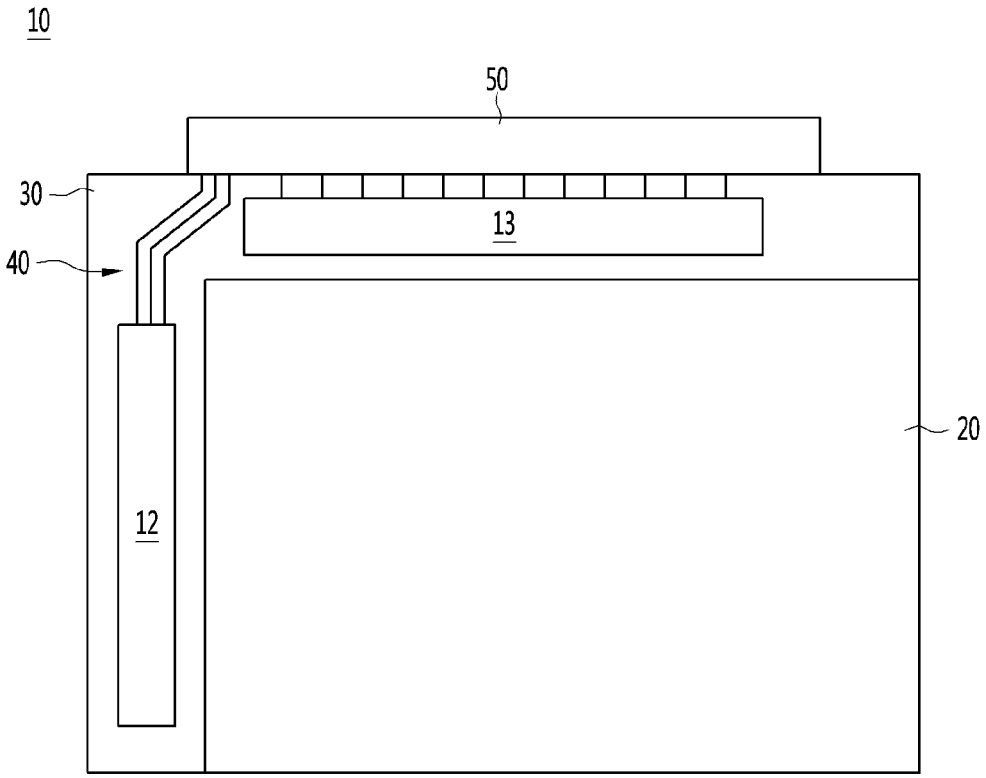
FIG. 1 (RELATED ART)
FIG. 1 is a block diagram showing a display device according to the related art.
Figure 2:
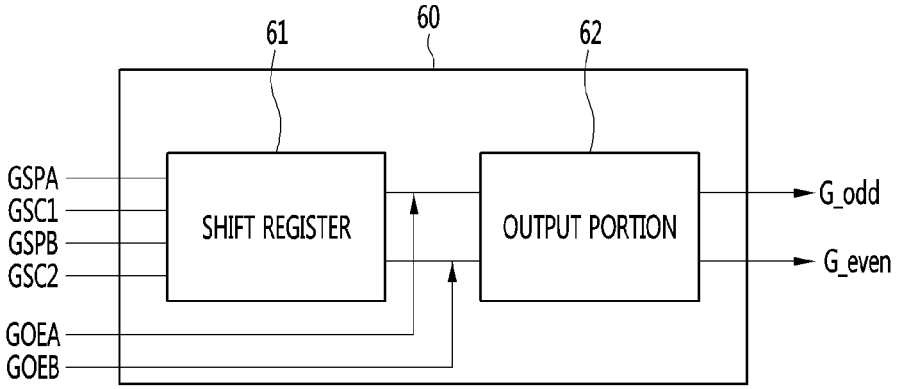
FIG. 2 (RELATED ART)
FIG. 2 is a detailed block diagram showing a configuration of a gate driver integrated-circuit (IC) chip which is disposed in the gate driver of FIG. 1.

Advantages and features of the present disclosure, and implementation methods thereof will be clarified through the following embodiments described with reference to the accompanying drawings. These embodiments introduced hereinafter are provided as examples in order to convey their spirits to the ordinary skilled person in the art. As such, these embodiments might be embodied in a different shape, so are not limited to these embodiments described here. Therefore, the present disclosure must be defined by scopes of claims.

In the following description, numerous specific details are set forth, such as particular structures, sizes, ratios, angles, coefficients and so on, in order to provide an understanding of the various embodiments of the present disclosure. However, it will be appreciated by one of ordinary skill in the art that the various embodiments of the present disclosure may be practiced without these specific details. The same reference numbers will be used throughout this disclosure to refer to the same or like parts. In other instances, well-known technologies have not been described in detail in order to avoid obscuring the present disclosure.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof. As used herein, the singular forms "a", an and the are intended to include the plural forms as well, unless the context clearly indicates otherwise.

Elements used in the present disclosure without additional specific details must be considered to include tolerance.

In the description of embodiments, when a structure is described as being positioned "on or above" or "under or below" another structure, this description should be construed as including a case in which the structures contact each other as well as a case in which a third structure is disposed therebetween.

The temporal terms of "after", "subsequently", "next", "before" and so on used in this disclosure without specifying "immediately" or "directly" can include other discontinuously temporal relations.

Moreover, although some of the elements are designated with numerical terms (e.g., first, second, third, etc.), it should be understood that such designations are only used to specify one element from a group of similar elements, but not to limit the element in any specific order. As such, an element designated as a first element could be termed as a second element or as third element without departing from the scope of exemplary embodiments.

The features of various exemplary embodiments of the present disclosure may be partially or entirely bound or combined with each other, and be technically engaged and driven using various methods as apparent to those skilled in the art, and the exemplary embodiments may be independently practiced alone or in combination.

Reference will now be made in detail to the embodiments of the present disclosure, examples of which are illustrated in the accompanying drawings. Also, the size and thickness of the device might be expressed to be exaggerated for the sake of convenience in the drawings. Wherever possible, the same reference numbers will be used throughout this disclosure including the drawings to refer to the same or like parts.

Also, the present disclosure can be applied to a COG display device and an LOG display device, which each include a plurality of signal lines formed on a non-display area of a display panel, in the same manner.

Figure 3:
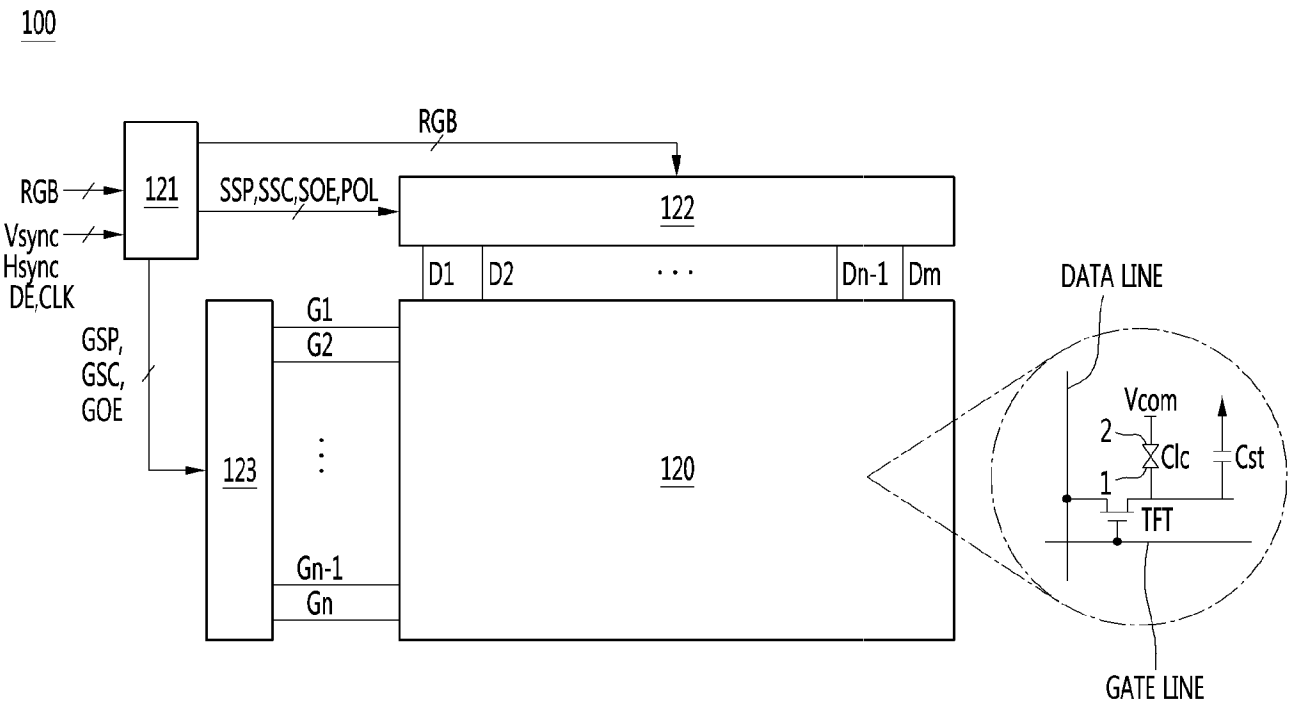
FIG. 3 is a block diagram showing a display device according to an embodiment of the present invention.

FIG. 3 is a block diagram showing a display device according to an embodiment of the present disclosure. FIG.

Figure 5:
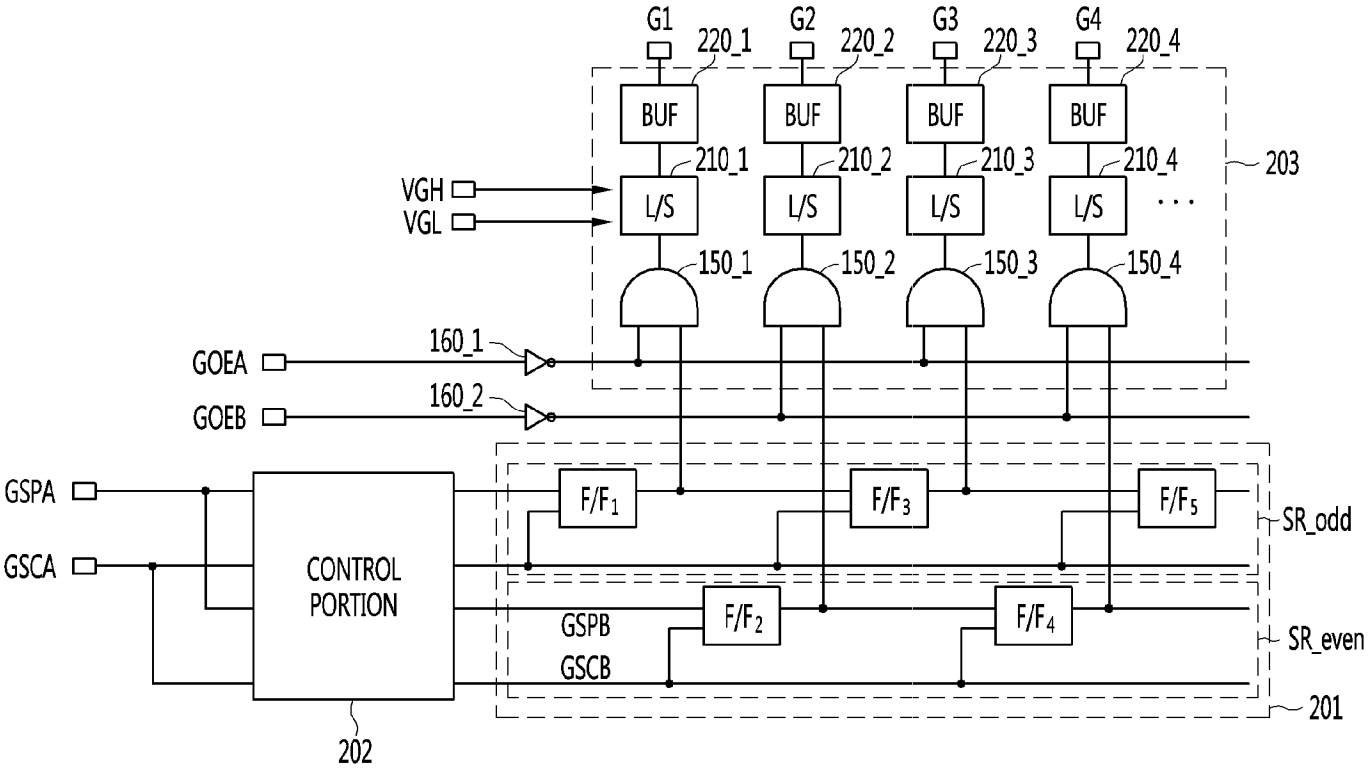
FIG. 5 is a detailed circuit diagram showing the gate driver IC chip of FIG. 4.
Figure 6:
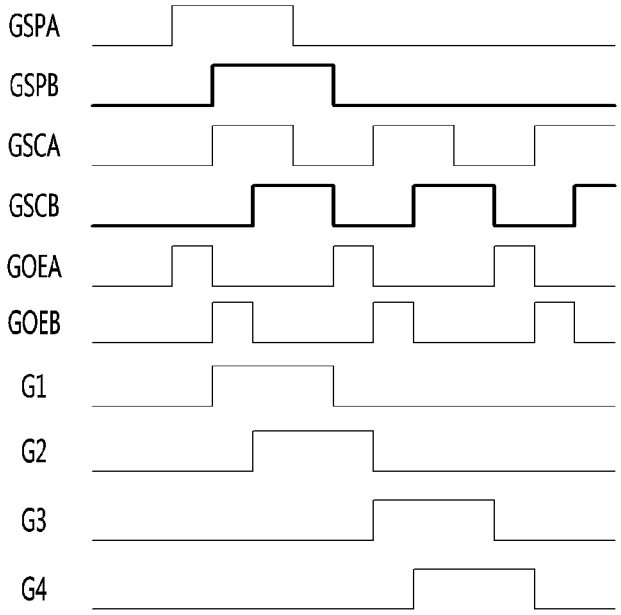
FIG. 6 is a waveform diagram showing waveforms of signals used in the gate driver IC chip of FIG. 5.

4 is a detailed block diagram showing a configuration of a gate driver IC chip which is disposed in the gate driver of FIG. 3. FIG. 5 is a detailed circuit diagram showing the gate driver IC chip of FIG. 4. FIG. 6 is a waveform diagram showing waveforms of signals used in the gate driver IC chip of FIG. 5.

Referring to FIGS. 3 through 6, a display device according to an embodiment of the present disclosure includes a display panel 120, a timing controller 121, a source driver 122 and a gate driver 123. The source driver 122 and the gate driver 123 are directly disposed on a substrate of the display panel 120. All the components of the display device according to the embodiments of the present invention are operative coupled and configured.

Figure 4:
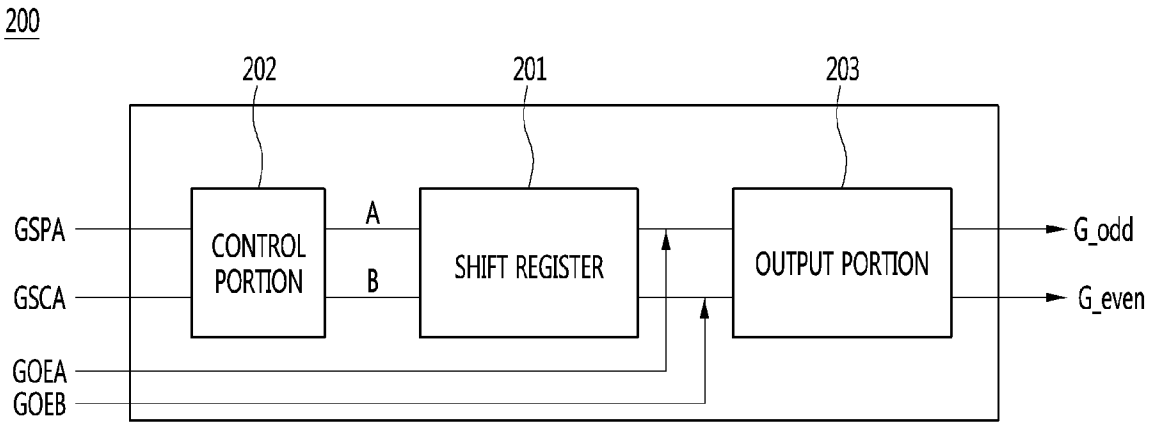
FIG. 4 is a detailed block diagram showing a configuration of a gate driver IC chip which is disposed in the gate driver of FIG. 3.

The gate driver 123 includes a plurality of gate driver IC chips (200 in FIG. 4). The gate driver IC chip 200 includes a control portion 202 configured to selectively delay gate control signals, a shift register 201 configured to generate gate signals which will be sequentially applied to gate lines arranged in the display panel 120, and an output portion 203 configured to output the gate signals generated in the shift register 203.

The display device 100 can become one of flat panel display devices such as liquid crystal display (LCD) devices, field emission display (FED) devices, plasma display panels (PDPs), organic light emitting diode (OLED) display devices, electrophoresis display (EPD) devices and so on. As an example of the display device 100 of the present embodiment, an LCD device will be mainly described. However, the display device of the present disclosure is not limited to the LCD device.

The display panel 120 includes liquid crystal molecules interposed between two glass substrates. In other words, the display panel 120 includes m×n liquid crystal cells Clc which are defined by crossing data lines D1~Dm and gate lines G1~Gn and arranged in a matrix shape. The 'm' and 'n' are positive integers.

The m data lines D1~Dm, the n gate lines G1~Gn and a pixel array are formed on a lower glass substrate of the display panel 120. The pixel array includes thin film transistors, pixel electrodes 1 of the liquid crystal cells Clc, which are connected to the thin film transistors TFT, and storage capacitors Cst.

A black matrix, a color filter layer and a common electrode 2 are formed on an upper glass substrate of the display panel 120. The common electrode 2 formed on the upper glass substrate allows the display panel 120 to be driven in a vertical field mode such as a twisted nematic or a vertical alignment mode. Alternatively, the display panel 120 is driven in one of horizontal field modes such as an in-plane switching (IPS) mode, a fringe field switching (FFS) mode and so on, the common electrode 2 together with the pixel electrodes 1 can be formed on the lower glass substrate.

Also, the display panel 120 includes polarizing plates with light axes crossing each other. The polarizing plates are attached on outer surfaces of the lower and upper glass substrates. Moreover, the display panel 120 includes alignment films which are used to set a pretilt angle of the liquid crystal molecules. The alignment films are formed on inner surfaces of the lower and upper glass substrates which come in contact with the liquid crystal cells.

The source driver 122 latches digital video data RGB, converts the latched digital video data RGB into positive/negative data voltages using positive/negative analog gamma voltages, and applies the converted positive/negative data voltages to the data lines D1~Dm. To this end, the source driver 122 is controlled by the timing controller 121.

Such a source driver 122 can be loaded on a tape carrier package (TCP) and bonded on the lower glass substrate of the display panel 120 through a tape automated bonding (TAB) process.

The shift register 201 disposed in the gate driver IC chip 200 of the gate driver 123 includes a first shift register SR_odd and a second shift register SR_even. The first shift register SR_odd is opposite to odd-numbered gate lines of the gate lines G1~Gn disposed on the display panel 120. The second shift register SR_even is opposite even-numbered gate lines of the gate lines G1~Gn on the display panel 120.

The output portion 203 of the gate driver IC chip 200 includes a plurality of first logical elements 150_1, 150_2, 150_3 and 150_4 . . . , a plurality of level shifters 210_1, 210_2, 210_3 and 210_4 . . . and a plurality of buffers 220_1, 220_2, 220_3 and 220_4 . . . .

Such an output 203 can selectively output the gate signals in response to a gate output enable signals GOE. Also, at least one second logical element 160_1 and 160_2 can be disposed on at least one input line of the output portion 203 which receives the gate output enable signal GOE.

The gate driver 123 sequentially applies the gate signals to the gate lines G1~Gn under control of the timing controller 121. The gate signals can be scan pulses which each have a pulse width of about single horizontal period. Such a gate driver 123 can be loaded on another TCP and bonded to the lower glass substrate of the display panel 120 through the TAB process. Alternatively, the gate driver 123 can be simultaneously formed on the lower glass substrate through a gate-in-panel (GIP) procedure when the pixel array is formed.

The timing controller 121 rearranges digital video data RGB applied from an external system board into a format suitable for the display panel 120. The rearranged digital video data RGB is transferred from the timing controller 121 to the source driver 122.

Also, the timing controller 121 inputs timing signals from the external system board. The timing signals includes vertical/horizontal synchronous signals Vsync and Hsync, a data enable signal DE, one of a clock signal CLK and a main clock signal MCLK and so on. The timing controller 121 derives timing control signals from the timing signals. The timing control signals are used to control operation timings of the source driver 122 and the gate driver 123. Also, the control signals generated in the timing controller 121 include data timing control signals and gate timing control signals.

The data timing control signal used to control the source driver 122 includes a source start pulse SSP, a source sampling clock SSC, a polarity control signal POL, a source output enable signal SOE and so on. The source start pulse SSP is used to control a start timing of a data sampling operation of the source driver 122. The source sampling clock SSC is used to control the data sampling operation of the source driver 122. In detail, the source driver 122 samples the digital video data RGB every one of rising and falling edges of the data sampling clock SSC. The source output enable signal SOE is used to control an output timing of the source driver 122. The polarity control signal POL is used to control a horizontal polarity inversion timing of the data voltage being output from the source driver 122.

The gate timing control signals used to control the gate driver 123 includes a gate start pulse GSP, a gate shift clock GSC, a gate output enable signal GOE and so on.

In the display device 100 of the present disclosure, the shift register 201 disposed in the gate driver IC chip 200 of the gate driver 123 is separated into the first shift register SR_odd opposite to the odd-numbered gate lines of the gate lines G1~Gn and the second shift register SR_even opposite to the even-numbered gate lines of the gate lines G1~Gn.

In order to drive such first and second shift registers SR_odd and SR_even, not only a first gate start pulse GSPA and a first gate shift clock GSCA must be applied from the timing controller 121 to the first shift register SR_odd but also a second gate start pulse GSPB and a second gate shift clock GSCB must be applied from the timing controller 121 to the second shift register SR_even.

However, the display device 100 of the present disclosure allows the gate driver IC chip 200 to input only the first gate start pulse and the first gate shift clock GSCA. The gate driver IC chip 200 drives the first and second shift registers SR_odd and SR_even using the first gate start pulse GSPA and the first gate shift clock GSCA. As such, the display device 100 of the present disclosure can reduce the number of signal lines.

Also, as the number of control signals applied to the gate driver 123 decreases, the timing controller 121 can apply a smaller number of control signals to the gate driver 123 compared to those in the related art. In accordance therewith, the number of elements arranged on the printed circuit board which is loaded with the timing controller 121 can be reduced.

Moreover, since the number of signal lines formed on the display panel 120 decreases, the bezel area of the display device 100 can be reduced.

As shown in the drawings, the first shift register SR_odd includes first, third and fifth stages F/F1, F/F3 and F/F5 . . . disposed opposite to the odd-numbered gate lines of the gate lines G1~Gn. The second shift register SR_even includes second, fourth and sixth stages F/F2, F/F4 and F/F6 . . . disposed opposite to the even-numbered gate lines of the gate lines G1~Gn.

The present disclosure forces the control portion 202 to be disposed at the previous stage of the shift register 201. The control portion 202 directly transfers the first gate start pulse GSPA and the first gate shift clock GSCA to the first shift register SR_odd. Also, the control portion 202 derives a second gate start pulse GSPB and a second gate shift clock GSCB from the first gate start pulse GSPA and the first gate shift clock GSCA. The second gate start pulse GSPB and the second gate shift clock GSCB are transferred from the control portion 202 to the second shift register SR_even.

Alternatively, the control portion 202 can be disposed at the next stage of the shift register 201 as the specification or necessity of the display device 100 arises.

The second gate start pulse GSPB and the second gate shift clock GSCB can be obtained by delaying the first gate start pulse GSPA and the first gate shift clock GSCA during a fixed period.

To this end, the control portion 202 can include a counter unit and a buffer unit. The counter unit counts a delay period of the first gate start pulse GSPA and the first gate shift clock GSCA. The buffer unit transfers the first and second gate start pulses GSPA and GSPB and the first and second gate shift clocks GSCA and GSCB to the shift register 201.

Also, the control portion 202 can adjusts the delay period of the first gate start pulse GSPA and the first gate shift clock GSCA using the counter unit. To this end, the control portion 202 can receive packet-shaped delay period information from the timing controller 121.

The first gate start pulse GSPA is generated once a frame period at a start time point of the frame period and used to derive a first gate pulse. The first gate start pulse GSPA is transferred from the control portion 202 to the first shift register SR_odd. The second gate start pulse GSPB, as a similar pulse to the first gate start pulse GSPA, is generated in the control portion 202 by delaying the first gate start pulse GSPA. The second gate start pulse GSPB is applied from the control portion 202 to the second shift register SR_even.

The first gate shift clock GSCA is commonly applied to all the stages of the first shift register SR_odd. Such a first gate shift clock GSCA is used to shift the first gate start pulse GSPA along the stages of the first shift register SR_odd.

Similarly, the second gate shift clock GSCB is generated in the control portion 202 by delaying the first gate shift clock GSCA. The second gate shift clock GSCB is applied to the stages of the second shift register SR_even and used to sequentially shift the second gate start pulse GSPB along the stages of the second shift register SR_even.

In this manner, the display device 100 of the present disclosure can generate the gate signals by driving the two separated shift register SR_odd and SR_even using only a pair of gate start pulse GSPA and gate shift clock GSCA.

An operation of the gate driver 123 with the above-mentioned configuration will now be described in detail.

The timing controller 121 generates the first gate start pulse GSPA and the first gate shift clock GSCA which are used to drive the first shift register SR_odd. The first gate start pulse GSPA and the first gate shift clock GSCA are applied from the timing controller 121 to the control portion 202 of the gate driver IC chip 200.

The first gate start pulse GSPA is transferred to the first stage F/F1 of the first shift register SR_odd through the control portion 202 without any delay. Then, the gate signal output from the first stage F/F1 is applied to the output portion 203 and the third stage F/F3 adjacent to the first stage F/F1.

The first gate shift clock GSCA is commonly transferred to the stages of the first shift register SR_odd through the control portion 202 without any delay.

On the other hand, the control portion 202 delays the first gate start pulse GSPA and the first gate shift clock GSCA and applies the delayed first gate start pulse and delayed first gate shift clock to the second shift register SR_even as the second gate start pulse GSPB and the second gate shift clock GSCB. In other words, the first gate start pulse GSPA and the first gate shift clock GSCA are converted into the second gate start pulse GSPB and the second gate shift clock GSCB, which are applied to the second shift register SR_even, by being delayed by the control portion 202.

The second gate start pulse GSPB is applied to the second stage F/F2 of the second shift register SR_even. Then, the gate signal is output from the second stage F/F2 and transferred to the output portion 203 and the fourth stage F/F4 adjacent to the second stage F/F2.

The second gate shift clock GSCB is commonly transferred from the control portion 202 to the stages of the second shift register SR_even.

As such, odd-numbered gate signals and even-numbered gate signals are output from the first and second shift registers SR_odd and SR_even. The odd-numbered gate signals and the even-numbered gate signals can be sequentially transferred to the display panel 120 through the respective level shifter 210_1, 210_2, 210_3 or 210_4 . . . and the respective buffer 220_1, 220_2, 220_3 or 220_4 . . . by the first and second gate output enable signals GOE applied from timing controller 121.

As described above, the gate driver, the display device with the same and the driving method thereof can drive the separated shift registers from each other using the small number of the gate timing control signals by disposing the control portion, which selectively delays the gate timing control signals such as GSP and GSC, at the previous stage of the separated shift registers from each other. In accordance therewith, the number of signal lines on the display panel can be reduced.

Also, the gate driver, the display device with the same and the driving method thereof can drive the two shift registers, which apply the gate signals to the odd-numbered and even-numbered gate lines, using only the gate timing control signal (such as GSP and GSC) supplied to one of the two shift registers. Therefore, the bezel area of the display device can be reduced.

Although the present disclosure has been limitedly explained regarding only the embodiments described above, it should be understood by the ordinary skilled person in the art that the present disclosure is not limited to these embodiments, but rather that the explained embodiments are considered as preferable embodiments. Accordingly, the scope of the present disclosure shall be determined only by the appended claims and their equivalents without being limited to the detailed description.

What is claimed is:

1. A gate driver comprising:

a shift register configured to include a first shift register opposite to odd-numbered gate lines of a display panel, and a second shift register opposite to even-numbered gate lines of the display panel; and a control portion configured to directly transfer a first control signal to the first shift register, derive a second control signal from the first control signal by delaying the first control signal, and apply the second control signal to the second shift register, wherein the control portion includes:

a counter configured to derive the second control signal by delaying the first control signal and count a delay period of the first control signal; and a buffer configured to output the second control signal to the second shift register, and wherein the control portion adjusts a delay period of the first control signal using the counter.

2. The gate driver of claim 1, wherein the first control signal includes a first gate start pulse and a first gate shift clock, and wherein the second control signal includes a second gate start pulse and a second gate shift clock.

3. The gate driver of claim 2, wherein the second control signal is derived from the first control signal by delaying the first gate start pulse to obtain the second gate start pulse, and delaying the first gate shift clock to obtain the second gate shift clock.

4. The gate driver of claim 1, further comprising an output portion configured to output gate signals generated in the first and second shift registers.

5. A display device comprising:

a display panel in which a plurality of gate lines and a plurality of data lines are formed, the plurality of gate lines including odd-numbered gate lines and even-numbered gate lines; and a gate driver which includes:

a first shift register opposite to the odd-numbered gate lines of the display panel;

a second shift register opposite to the even-numbered gate lines of the display panel; and a control portion configured to directly transfer a first control signal to the first shift register, derive a second control signal from the first control signal by delaying the first control signal, and apply the second control signal to the second shift register, wherein the control portion includes:

a counter configured to derive the second control signal by delaying the first control signal and count a delay period of the first control signal; and a buffer configured to output the second control signal to the second shift register, and wherein the control portion adjusts a delay period of the first control signal using the counter.

6. The display device of claim 5, wherein the first control signal includes a first gate start pulse and a first gate shift clock, and wherein the second control signal includes a second gate start pulse and a second gate shift clock.

7. The display device of claim 6, wherein the second control signal is derived from the first control signal by delaying the first gate start pulse to obtain the second gate start pulse, and delaying the first gate shift clock to obtain the second gate shift clock.

8. The display device of claim 5, wherein the gate driver further includes an output portion configured to output gate signals generated in the first and second shift registers to the gate lines of the display panel.

9. The display device of claim 5, wherein the gate driver is disposed on the display panel through one of chip-on-glass and line-on-glass processes.

* * * * *